US008377373B1

(12) United States Patent
Glennon et al.

(10) Patent No.: US 8,377,373 B1
(45) Date of Patent: Feb. 19, 2013

(54) COMPOSITIONS COMPRISING NICKEL-TITANIUM, METHODS OF MANUFACTURE THEREOF AND ARTICLES COMPRISING THE SAME

(75) Inventors: Glenn N. Glennon, Berlin, CT (US); Christopher DellaCorte, Medina, OH (US)

(73) Assignees: The United States of America, Washington, DC (US); Abbott Ball Company, West Hartford, CT (US)

( * ) Notice: Subject to any disclaimer, the term of this patent is extended or adjusted under 35 U.S.C. 154(b) by 758 days.

(21) Appl. No.: 12/544,674

(22) Filed: Aug. 20, 2009

(51) Int. Cl.
*C21D 1/00* (2006.01)

(52) U.S. Cl. ..... 419/29; 419/38; 419/42; 419/60; 420/451

(58) Field of Classification Search ..... 148/675; 419/28, 29; 420/441
See application file for complete search history.

(56) References Cited

U.S. PATENT DOCUMENTS

| | | | |
|---|---|---|---|
| 3,672,879 | A | 6/1972 | Buehler |
| 3,726,722 | A | 4/1973 | Foerster et al. |
| 4,133,680 | A | 1/1979 | Babaskin et al. |
| 4,282,033 | A | 8/1981 | Goldstein et al. |
| 4,719,077 | A | 1/1988 | Suzuki et al. |
| 5,078,964 | A | 1/1992 | Arndt et al. |
| 6,422,010 | B1 | 7/2002 | Julien |
| 6,607,693 | B1 | 8/2003 | Saito et al. |
| 6,886,986 | B1 | 5/2005 | Julien |

OTHER PUBLICATIONS

M.D. McNeese et al. Processing of TiNi from elemental powders by hot isostatic pressing, Materials Science and Engineering A280, (2000), pp. 334-348.*
David M Goldstein, "Production of Shaped Parts of Nitinol Alloys by Solid-State Sintering," NSWC TR 84-326, Oct. 15, 1984.*
B Lynn Ferguson and Randall German, "Powder Shaping and Consolidation Technologies," ASM Handbook, vol. 7 (1998), pp. 313-320.*
C. DellaCorte, et al. "Intermetallic Nickel-Titanium Alloys for Oil-Lubricating Bearing Applications" NASA/TM 2009-215646. Mar. 2009.
William J. Buehler, Frederick E. Wang, "A Summary of Recent Research on the Nitinol Alloys and Their Potential Application in Ocean Engineering" Ocean Engineering, vol. 1, pp. 105-120, Pergamon Press 1968. Jul. 21, 1967. Printed in Great Britain.
William J. Buehler, "Intermettallic Compound Based Materials for Structural Application", U.S. Naval Ordinance Laboratory Silver Springs, Maryland, The Seventh Navy Science Symposium: Solution to Navy Problems Through Advanced Technology, May 14,15,16, 1963, U.S. Naval Aviation Medical Centor, Pensacola, Florida. vol. 1, pp. 1-31.

(Continued)

*Primary Examiner* — Roy King
*Assistant Examiner* — Christopher Kessler
(74) *Attorney, Agent, or Firm* — Cantor Colburn LLP

(57) ABSTRACT

Disclosing herein is a method for manufacturing nickel-titanium compositions. The method includes disposing a powdered composition in a mold; the powdered composition comprising nickel and titanium; the titanium being present in an amount of about 38 to about 42 wt % and the nickel being present in an amount of about 58 to about 62 wt %; sintering the powdered composition to produce a sintered preform; compacting the preform; machining the preform to form an article; heat treating the article; the annealing being conducted at a temperature of about 1650° F. to about 1900° F. at a pressure of about 3 Torr to about 5 Kg-f/cm$^2$ for a time period of about 10 minutes to about 5 hours; and quenching the article.

8 Claims, 3 Drawing Sheets

OTHER PUBLICATIONS

William J. Buehler, J.V. Gilfrich, and R.C. Wiley, Effect of Low-Temperature Phase Changes on the Mechanical Properties of Alloys near Composition TiNi, U.S. Naval Ordinance Laboratory, Silver Spring, Maryland, Journal of Applied Physics, vol. 34, No. 5, May 1963, pp. 1475-1477.

Richard W. Roberts, Robert S. Owens, "Titanium Lubrication", Nature, vol. 200, Oct. 26, 1963, pp. 357-358.

William R. Jones, Jr., Stephen V. Pepper and Donald R. Wheeler, Nasa Glenn Research Center, Cleveland, OH, Mark J. Jansen and Quynhgiao Nguyen, Brookpark, OH, Achim Scroer, Neuchatel, Switzerland, The Effect of Stress and TiC Coated Balls on Lifetime of a Perflouropolyalkylether Using a Vacuum Rolling Contact Tribometer, Tribology Conference in Seattle Washington, Oct. 1-4, 2000, Jul. 10, 2000, pp. 685-688.

Michael N. Gardos, Hyun-Soo Hong and Ward O. Winer, "The Effect of Anion Vacancies on the Tribological Properties of Rutile (TIO2-x), Part II: Experimental Evidence", Annual Meeting in Atlanta, Georgia, May 1-4, 1989, vol. 22 (1990), pp. 209-220.

William R. Jones, Jr. and Stephen V. Pepper, Glenn Research Center, Cleveland, OH, Mark J. Jansen and QuynhGiao N. Nguyen, AYT Corporation, Brook Park, OH, Edward P. Kingsbury, IRC, Walpole, Massachusets, Stuart H. Loewenthal, Lockheed Martin Missiles and Space, Sunnyvale, CA, Roamer E. Predmore, Goddard Space Flight Center, Greenbelt, Maryland, A New Apparatus to Evaluate Lubricants for Space Applications—The Spiral Orbit Tribometer (SOT), NASA/TM—2000-209935, Mar. 2000, pp. 1-7.

* cited by examiner

COMPOSITIONS COMPRISING NICKEL-TITANIUM, METHODS OF MANUFACTURE THEREOF AND ARTICLES COMPRISING THE SAME

BACKGROUND

This disclosure is directed to ball bearings comprising nickel-titanium and to methods of manufacture thereof.

Bearings such as those used in reducing sliding friction (e.g., bushings, journal bearings, sleeve bearings, rifle bearings, plain bearings, or the like) or those used in reducing rolling friction (e.g., ball bearings, roller bearings, or the like) are often manufactured from materials comprising metals, ceramics or organic polymers. Examples of metals are stainless steel, bronze, aluminum, or the like. Examples of ceramics are sapphire, glass, or the like. Examples of polymers are nylon, polyoxymethylene, polytetrafluoroethylene, polyolefins, or the like.

One problem with the aforementioned metals, ceramics and polymers is corrosion. For example bearings manufactured from steel can undergo rusting, which reduces the ability of the bearing to minimize friction over time.

In addition, lubricants used on the bearings also can undergo degradation to reduce the ability of the bearing to minimize friction. Often, the by-products of friction contaminate the lubricants, which render damage to the bearing as well as the lubricant.

It is therefore desirable to manufacture bearings from materials that do not undergo corrosion and that do not produce by-products that damage the bearing or the lubricant. Nitinol 60 (comprising about 60 weight percent nickel and about 40 weight percent titanium) produces parts that are resistant to corrosion. One of the drawbacks of Nitinol 60 is that it is difficult to manufacture components from it that are without casting defects such as voids and pinholes. When a Nitinol 60 component is manufactured by casting a melt into a mold, it generally contains voids and pinholes, which ruins the surface finish and renders the component unusable for its intended application. It is therefore desirable to manufacture Nitinol 60 components that are devoid of casting defects and that can be polished to fine tolerances. Another drawback of Nitinol 60 is that it is very hard and therefore difficult to machine. It is also desirable to manufacture these components to fine tolerances so as to minimize any additional undesirable machining.

SUMMARY

Disclosing herein is a method for manufacturing nickel-titanium compositions. The method includes disposing a powdered composition in a mold; the powdered composition comprising nickel and titanium; the titanium being present in an amount of about 38 to about 42 wt % and the nickel being present in an amount of about 58 to about 62 wt %; sintering the powdered composition to produce a sintered preform; compacting the preform; machining the preform to form an article; heat treating the article; the annealing being conducted at a temperature of about 1650° F. to about 1900° F. at a pressure of about 3 Torr to about 5 Kg-f/cm$^2$ for a time period of about 10 minutes to about 5 hours; and quenching the article.

DETAILED DESCRIPTION

Figure 1:
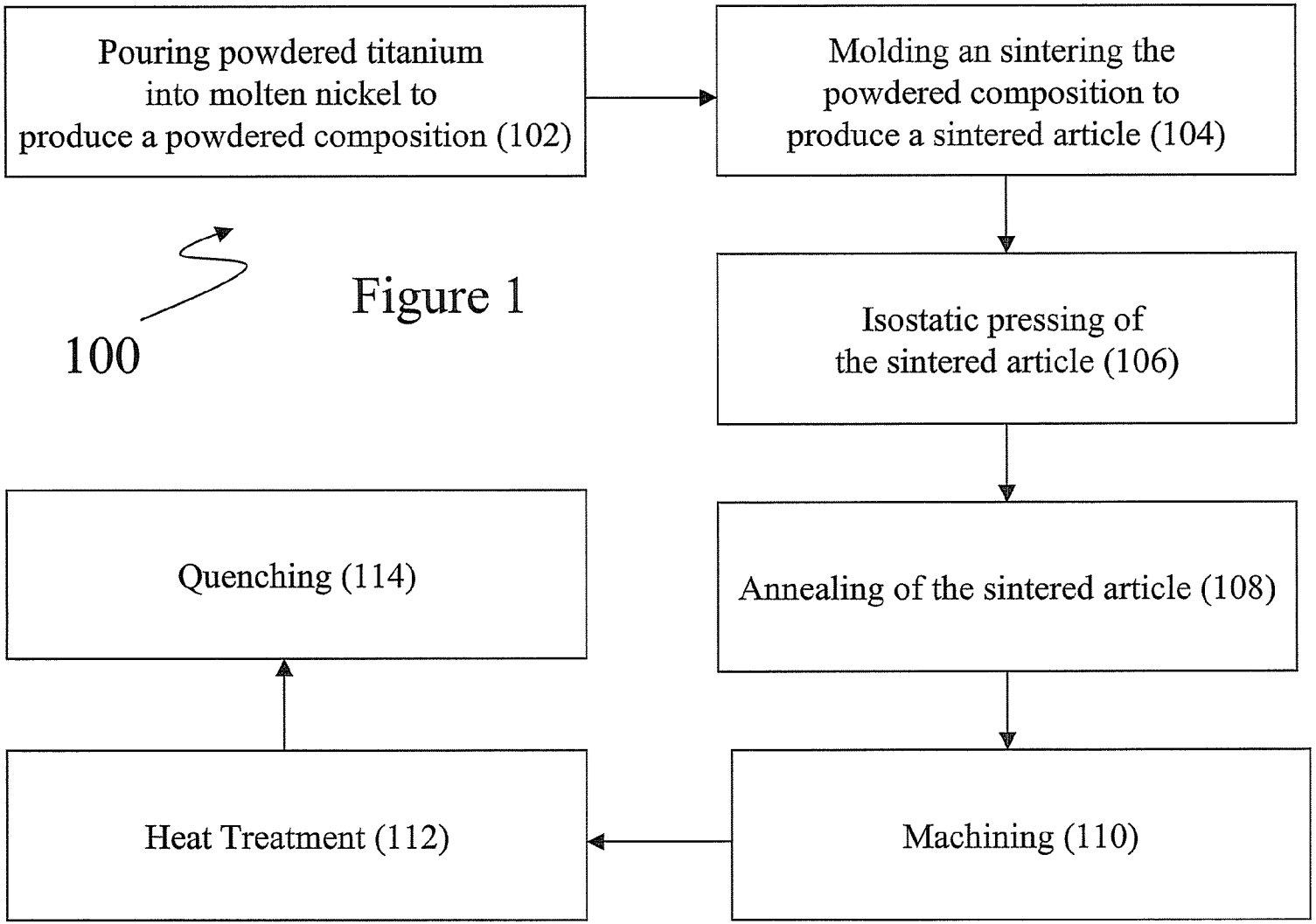
FIG. 1 is a schematic depiction of an exemplary method of manufacturing an article using a nickel-titanium composition.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

The transition phrase "comprising" may be replaced with the transition phrases "consisting of" or "consisting essentially of".

Disclosed herein is a method for manufacturing articles from a nickel-titanium composition that comprises nickel in an amount of about 58 to about 62 weight percent (wt %) and titanium in an amount of about 38 to about 42 wt %. The method comprises manufacturing a powdered composition of nickel-titanium particles. The powdered composition of nickel-titanium particles is then placed in a mold and sintered to a first temperature at a first pressure for a first period of time to produce a sintered preform. The sintered preform is then annealed at a second temperature, a second pressure for a second period of time to produce an annealed preform. The annealed preform is then subjected to machining to produce articles having the desired geometry. Following the manufacturing of the article with the desired geometry, it is then heat treated to a third temperature at a third pressure for a third period of time. The article was then quenched to develop an article having a Rockwell hardness of greater than 55 Rockwell C.

Disclosed herein too is a nickel-titanium composition that comprises at least 4 different phases of nickel-titanium, each phase having a different atomic ratio of nickel to titanium. The nickel-titanium composition is advantageous in that it can be used in frictional devices without damaging or degrading lubricants employed in the frictional devices for extended periods of time. This leads to extended life cycles for the lubricants as well as the frictional device thereby reducing costs associated with maintenance downtime and product replacement.

The nickel-titanium composition disclosed herein is especially advantageous because the nickel-titanium phases contained therein do not degrade lubricants in a manner similar to other commercially available nickel-titanium compositions. Titanium metal is known to be very aggressive towards lubricants. The titanium present in other commercially available nickel-titanium alloys therefore causes a degradation of the lubricant, which causes galling and seizing of frictional devices in which it is employed. However, in the nickel-titanium compositions disclosed herein, the titanium is effectively passivated by being bonded to nickel so that it does not aggressively attack lubricants that are used in its presence. The hardness of the nickel-titanium composition together with its low density, high corrosion resistance and non-magnetic properties make the composition useful for applications in space.

Disclosed herein too is a friction reducing composition that comprises the nickel-titanium composition and a lubricant. The lubricant can comprise a fluid such as an oil, a grease, water, or the like. The friction reducing composition can be advantageously used in a frictional device without any degradation of the lubricant.

With reference now to the FIG. 1, a method 100 for manufacturing the nickel-titanium composition comprises pouring powdered titanium into molten nickel or pouring powdered nickel into molten titanium to produce a powdered composition (102), molding and sintering the powdered composition (104) to a first temperature at a first pressure for a first period of time to produce a sintered preform. The sintered preform is then subjected to hot isostatic pressing (106) followed by optional machining (108) and to further heat treatment (110) and quenching (114) to produce the desired nickel-titanium article.

Figure 2:
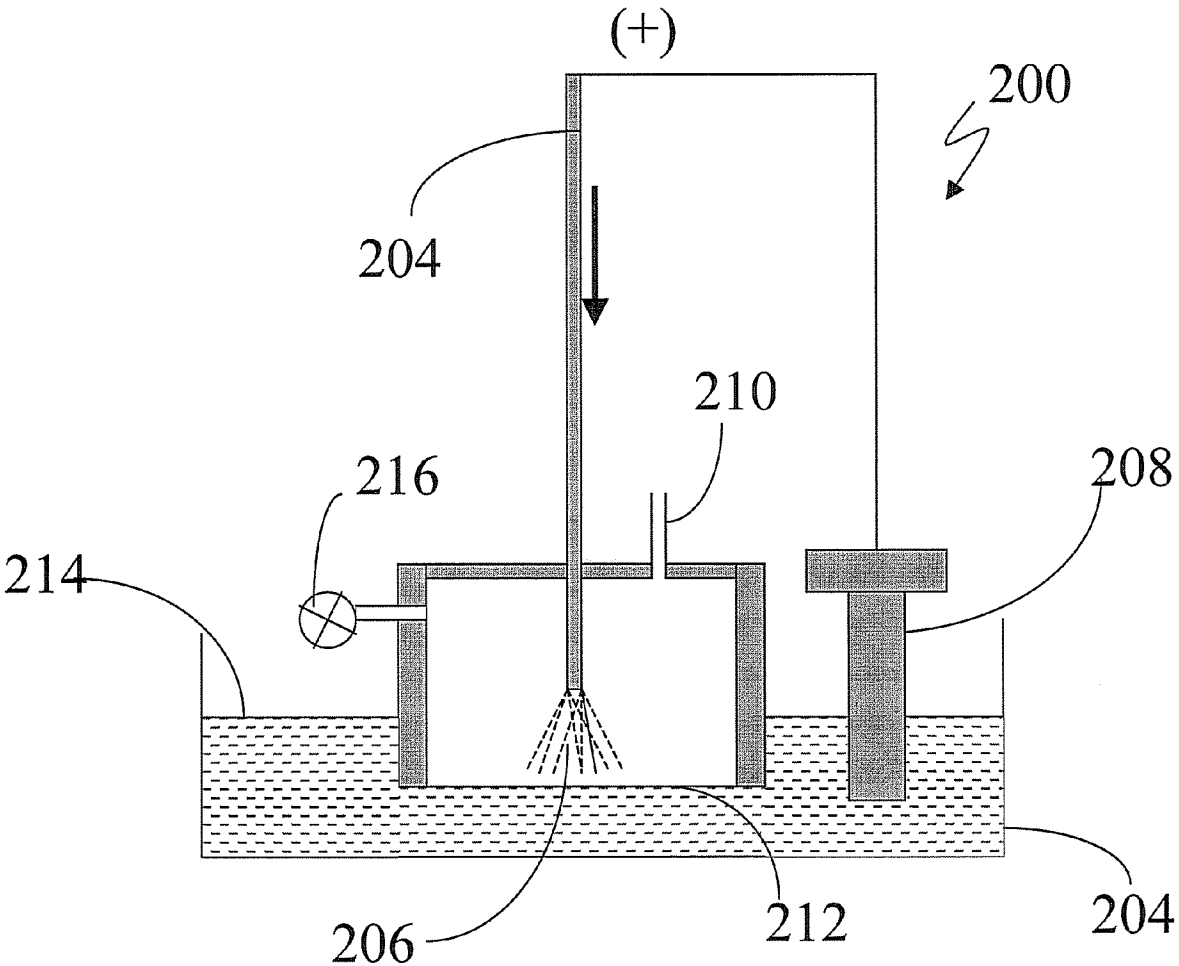
FIG. 2 is an exemplary depiction of a device that is used to manufacture nickel-titanium powdered compositions.

The powdered composition may be obtained by a variety of methods. With reference now to the FIG. 2, a titanium elongate mass 202 is fed into a crucible 204 containing molten nickel in a device 200 to produce the powdered composition (102) that comprises a nickel-titanium alloy. The titanium elongate mass 202 is generally disposed perpendicular to the surface of the molten nickel in the crucible 204. Examples of the elongate mass are a wire, a rod, a tube, a bar, or the like. The titanium elongate mass is also fed with an effective electrical current from a source 208. The electrical current is fed to the titanium elongate mass at a constant voltage and at current limiting condition to create and electric arc and to facilitate the formation of a spray of molten titanium particles 206. The spray of molten titanium particles 206 falls into the molten nickel by the action of gravity and is then dispersed into the molten nickel to form nickel-titanium alloy particles.

The molten nickel is loaded into a crucible in a furnace. The amount of nickel in the crucible is adjusted so that its weight in the powdered composition will be about 58 to about 62 wt %, specifically about 59 to about 61 wt %, and more specifically about 59.5 to about 60.5 wt % of the powdered composition. An exemplary amount of nickel is about 60 wt % of the powdered composition.

The remaining weight of the powdered composition is titanium. In an exemplary embodiment, the titanium will be about 38 to about 42 wt %, specifically about 39 to about 41 wt %, and more specifically about 39.5 to about 40.5 wt % of the powdered composition. An exemplary amount of titanium is about 40 wt % of the powdered composition.

The crucible is maintained at a temperature of greater than or equal to the melting point of nickel. It is desirable to maintain the crucible at a temperature that is less than or equal to the melting point of titanium. The crucible is heated by a suitable power source to maintain the molten nickel in the melt state. During the feeding of the titanium into the molten nickel or vice versa, the crucible is first purged with an inert gas through a port 210. The inert gas exits the device through a relief valve 216. The inert gas displaces any reactive gases present in the crucible. It is also desirable for the inert gas to depress the surface of the molten nickel at the alloying zone. As can be seen in the FIG. 2, the height 212 of the surface of the molten nickel in the alloying zone is lower than the height 214 of the surface of the molten nickel outside the alloying zone. The alloying zone is the zone where the spray of molten titanium particles contacts the molten nickel.

Examples of suitable inert gases are argon, nitrogen, helium, xenon, nitrogen, carbon dioxide or carbon monoxide. In one embodiment, the feeding of the titanium elongate mass into the molten nickel is conducted in an argon atmosphere. The crucible is sealed so as to be isolated from the ambient atmosphere.

As the spray of molten titanium enters the molten nickel, it forms solid particles of a nickel-titanium alloy, which are then collected from the bottom of the crucible and are subjected to sintering to form the sintered preform. The particles so recovered form an occluded mass. For example, the particles of nickel-titanium can be removed from the molten nickel as a mass of particles with occluded nickel. The occluded nickel can be removed by further treatment to yield the nickel-titanium powdered composition, which is then subjected to sintering.

Figure 3:
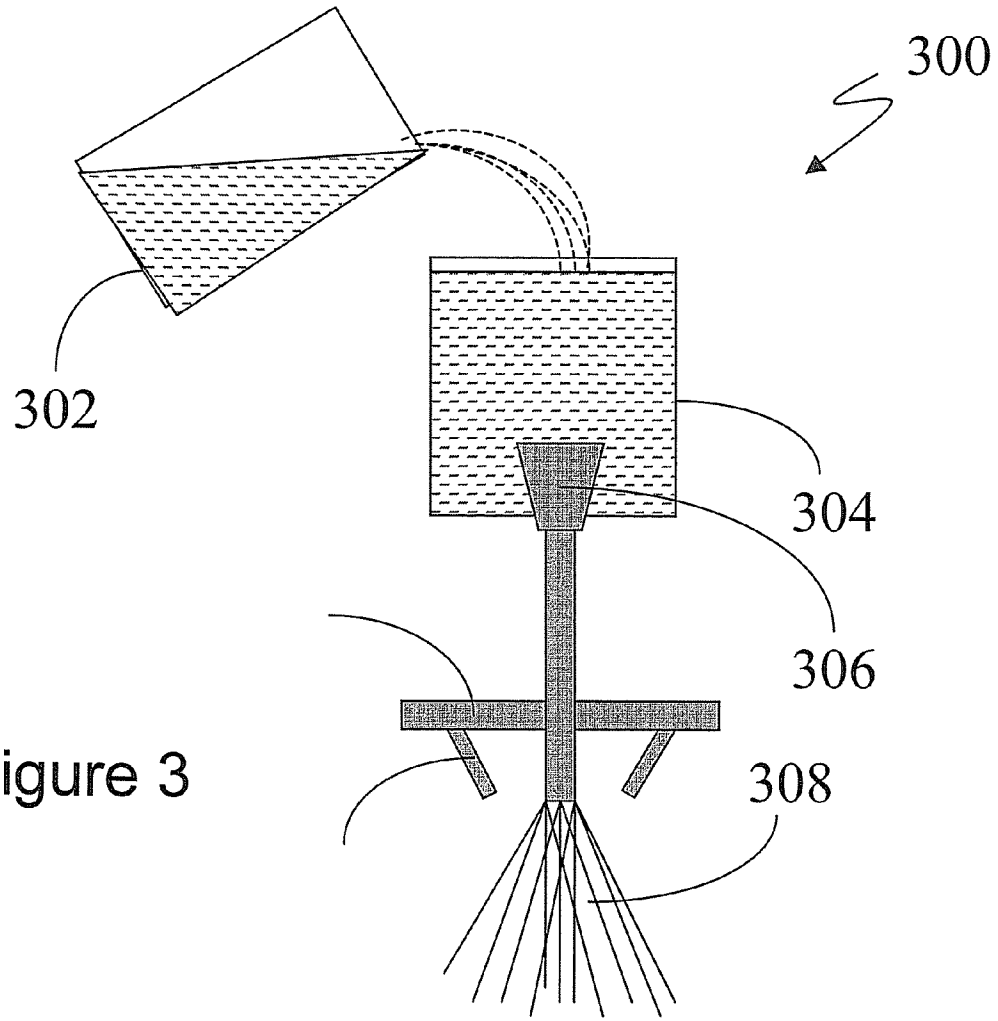
FIG. 3 is an exemplary depiction of another device that is used to manufacture nickel-titanium powdered compositions.

The FIG. 3 depicts another device 300 that can be used for the production of the nickel titanium powdered composition. In one embodiment, in another method of manufacturing the powdered composition, molten titanium is poured from a first crucible 302 into a second crucible 304, which contains molten nickel as depicted in the FIG. 3.

The amount of molten nickel loaded into the second crucible 304 will be about 58 to about 62 wt %, specifically about 59 to about 61 wt %, and more specifically about 59.5 to about 60.5 wt % of the powdered composition. An exemplary amount of nickel is about 60 wt % of the powdered composition that is formed as detailed below.

The amount of molten titanium that is discharged from the first crucible 302 into the second crucible 304 will be about 38 to about 42 wt %, specifically about 39 to about 41 wt %, and more specifically about 39.5 to about 40.5 wt % of the powdered composition. An exemplary amount of titanium is about 40 wt % of the powdered composition.

The second crucible 304 contains a teeming nozzle 306 whose function it is to meter the molten nickel and titanium into the atomizing zone 308. As the molten alloy passes through the teeming nozzle 306 an inert gas is passed through the plenum 308 and discharged through the jets 310 to impinge on the molten metal. The plenum generally has about 8 jets through which the inert gas is discharged. In one embodiment, 4 jets can be arranged to discharge the inert gas at a location that is closed to the atomizing zone, while 4 other jets are positioned at a point further downstream from the atomizing zone (not shown). The entire device 300 depicted in the FIG. 3 can be enclosed (not shown) to prevent any reactive gases from contacting the molten metals. The enclosure is generally purged with an inert gas prior to pouring the molten titanium from the first crucible 302 into the second crucible 304. Argon is generally used as the inert gas in the jets as well as in the enclosure.

The molten alloy is discharged from the atomizing zone in the form of a powder and can be collected in a cooling bath. The powder can be cooled in a bath. The bath can contain cold water, liquid nitrogen, liquid argon, liquid helium, or the like.

In one embodiment, in one method of manufacturing the powered composition using the device of the FIG. 3, molten titanium is poured into the molten nickel while several jets of argon gas are directed into the mixture of molten nickel and molten titanium to disperse the mixture into particles that comprise nickel and titanium. The particles freeze into tiny spheroids at the bottom of the device 300 where they are cooled by a pool of liquid argon.

In both methods of manufacturing particles disclosed above, the powdered composition has an average particle size of about 50 to about 150 micrometers, specifically about 70 to about 130 micrometers, and more specifically about 80 to about 120 micrometers. An exemplary average particle size for the powdered composition is less than or equal to about 100 micrometers.

In yet another method of manufacturing the powdered composition, nickel powder and titanium powder are ground together in a ball mill. Ball milling generally causes an intimate mixing of the nickel with the titanium. The ball milling may be conducted with stainless steel balls.

The ball milling can be conducted for a period of 15 minutes to about 180 minutes, specifically about 30 to about 150 minutes, and more specifically about 45 to about 120 minutes. After ball milling the powdered composition may be subjected to further processing as described below.

As noted in the Figure, the powdered composition is next subjected to molding and sintering (104) to produce a sintered preform. The powdered composition may be poured into molds of suitable shapes. As noted above, the powdered composition in the molds is subjected to a first temperature at a first pressure for a first time period. The molds are subjected to vibration in order to remove any entrapped air and then subjected to sintering in a furnace at a first temperature of about 1700° F. to about 2250° F. and a first pressure of 30 Torr to about 10 kilograms-force per square centimeter (Kg-f/cm$^2$) for a first time period of about 10 minutes to about 4 hours to produce a sintered preform. A vacuum may be applied to the mold prior to and during the heating operation to remove any entrapped gases from the powdered composition. The sintering may be conducted without a vacuum, under ambient conditions if desired The sintering is conducted for a first time period of about 10 minutes to about 4 hours. In one embodiment, the sintering is conducted at a first temperature of about 1800° F. to about 2200° F., specifically about 1800° F. to about 1900° F. The sintering is conducted at a first pressure of about 3 Torr to about 5 Kg-f/cm2, specifically about 2 Torr to about 2 Kg-f/cm$^2$. The sintering is conducted for a first time period of about 20 minutes to about 180 minutes, specifically about 50 minutes to about 150 minutes. In an exemplary embodiment, the sintering is conducted at a temperature of about 1825° F. to about 1950° F. at ambient pressure for about 120 minutes to form the sintered preform.

The sintered preform is then subjected to cooling. In one embodiment, the sintered preform is cooled down to room temperature.

After cooling, the sintered preforms are then removed and are subjected to hot isostatic pressure compaction (106). As noted above, during the hot isostatic pressure compaction, the sintered preform is subjected to a second temperature at a second pressure for a second time period. The hot isostatic pressure compaction is conducted in a hipping furnace.

The second temperature is about 1700° F. to about 2250° F., specifically about 1800° F. to about 2200° F., and more specifically about 1800° F. to about 1900° F. The second pressure is about 2110 to about 11250 Kg-f/cm$^2$, specifically about 3000 to about 9000 Kg-f/cm$^2$, and more specifically about 4000 to about 8000 Kg-f/cm$^2$. The second time is about 0.5 to about 20 hours, specifically about 1 to about 15 hours and more specifically about 2 to about 5 hours.

The hot iso statically pressed compact has a hardness of about 35 to about 45 when measured using a Rockwell C hardness test at room temperature (about 23° C.). The hot isostatically pressed compact is cooled to room temperature. After hot isostatic pressing, the preforms are free from defects and voids. The preforms may be used to produce a variety of commercial objects. In one embodiment, the preform may be used to produce devices that are used in frictional applications.

As noted above, the preforms may be optionally subjected to machining (110) to produce articles that can be used in a variety of different applications. After manufacturing a preform, the preform may be subjected to a variety of machining operations including grinding, milling, lapping, drilling, or the like, to produce the aforementioned articles.

The hot isostatically pressed compact is then subjected to machining to produce a desired article. Following machining the article may be subjected to heat treatment (112). The heat treatment (112) is generally conducted at a third temperature at a third pressure for a third time period. The third temperature is about 1650° F. to about 1900° F., specifically about 1750° F. to about 1850° F., and more specifically about 1775° F. to about 1810° F. The third pressure is about 3 Torr to about 5 Kg-Fcm2, specifically about 2 Torr to about 2 Kg-Fcm$^2$. The third time period for a time period of about 10 minutes to about 5 hours. In one embodiment, the heat treatment is generally conducted at a temperature of about 1750° F. to about 1850° F. for a time period of about 60 minutes to about 180 minutes. In an exemplary embodiment, the heat treatment may be conducted at a temperature of about 1790° F. at ambient pressure for a time period of 150 minutes.

Following the heat treatment, the preform or the machined article may be subjected to a rapid oil quench (114) to produce a hardened nickel-titanium composition. The hardened nickel-titanium composition generally has a hardness of greater than or equal to about 60 HRC. In one embodiment, the hardened nickel-titanium composition generally has a hardness of greater than or equal to about 62 HRC.

The article that is produced after subjecting the powdered composition to sintering, hot isostatic compaction and annealing has a novel composition. While the nickel-titanium composition contained in the preform comprises titanium in an amount of about 38 to about 42 wt % and nickel in an amount of about 58 to about 62 wt %, the nickel-titanium composition described herein comprises a first phase, a second phase, a third phase and a fourth phase. The first phase is the matrix phase that comprises nickel and titanium in an atomic ratio of about 0.45:0.55 to about 0.55:0.45, specifically about 0.48:0.52 to about 0.52:0.48. In an exemplary embodiment, the atomic ratio of nickel to titanium is about 1:1 and the composition of the phase is designated as NiTi.

The nickel-titanium composition comprises the first phase (NiTi) in an amount of about 65 to about 85 volume percent (vol %), specifically about 67 to about 80 vol %, and more specifically about 68 to about 78 vol %, based on the total volume of the nickel-titanium composition. In an exemplary embodiment, the nickel-titanium composition comprises the first phase (NiTi) in an amount of about 77 vol %, based on the total volume of the nickel-titanium composition.

The second phase comprises nickel and titanium in an atomic ratio of about 0.70:0.30 to about 0.80:0.20, specifically about 0.72:0.28 to about 0.78:0.22. In an exemplary embodiment, the atomic ratio of nickel to titanium is about 0.75:0.25 and the composition of the phase can be designated as $Ni_3Ti$.

The nickel-titanium composition comprises the second phase ($Ni_3Ti$) in an amount of about 7 to about 20 vol %, specifically about 8 to about 17 vol %, and more specifically about 9 to about 15 vol %, based on the total volume of the nickel-titanium composition. In an exemplary embodiment, the nickel-titanium composition comprises the first phase ($Ni_3Ti$) in an amount of about 9.8 vol %, based on the total volume of the nickel-titanium composition.

The third phase comprises nickel and titanium in an atomic ratio of about 0.52:0.48 to about 0.62:0.38, specifically about 0.54:0.46 to about 0.60:0.0.40. In an exemplary embodiment, the atomic ratio of nickel to titanium is about 0.57:0.43 and the composition of the phase can be designated as $Ni_4Ti_3$.

The nickel-titanium composition comprises the third phase ($Ni_4Ti_3$) in an amount of about 8 to about 15 vol %, specifically about 9 to about 14 vol %, and more specifically about 10 to about 13 vol %, based on the total volume of the nickel-titanium composition. In an exemplary embodiment, the nickel-titanium composition comprises the third phase ($Ni_4Ti_3$) in an amount of about 11 vol %, based on the total volume of the nickel-titanium composition.

The fourth phase comprises nickel and titanium in an atomic ratio of about 0.60:0.40 to about 0.67:0.33, specifically about 0.60:0.40 to about 0.75:0.25. In an exemplary embodiment, the atomic ratio of nickel to titanium is about 0.67:0.33 and the composition of the phase can be designated as $NiTi_2$.

The nickel-titanium composition comprises the fourth phase ($NiTi_2$) in an amount of up to about 5 vol %, specifically about 1 to about 4 vol %, and more specifically about 1.5 to about 3 vol %, based on the total volume of the nickel-titanium composition. In an exemplary embodiment, the nickel-titanium composition comprises the third phase ($NiTi_2$) in an amount of about 2.2 vol %, based on the total volume of the nickel-titanium composition.

The nickel-titanium composition comprises grains having an average grain size of about 20 to 80 micrometers, specifically about 30 to about 70 micrometers, and more specifically about 35 to about 60 micrometers. In an exemplary embodiment, the nickel-titanium composition comprises grains having an average size of about 40 micrometers.

The nickel-titanium composition thus manufactured has superior properties over other commercially available nickel-titanium compositions that are manufactured using other methods. The nickel-titanium composition is non-magnetic having a magnetic permeability of less than or equal to about 1.002. The nickel-titanium composition has a melting point of about 1,125° C. The nickel-titanium composition has an impact strength of up to about 56 foot-pound (ft-lb), and a surface hardness of about 40 to about 62 Rockwell (RC). In an exemplary embodiment, the nickel-titanium composition has a surface hardness of up to about 60 HRC. The nickel-titanium composition has a density of about 0.242 to about 0.246 pounds per inch. In an exemplary embodiment, the nickel-titanium composition has a density of about 0.244 pounds per inch (6.71 grams per cubic centimeter).

The nickel-titanium composition has Young's modulus of 114 gigapascals (GPa). The elongation at break for the nickel-titanium composition is up to about 7% and the Young's Modulus can be up to about $16.5\times10^6$ psi. The nickel-titanium composition has an electrical resistivity of up to about $80\times10^{-6}$ ohm-centimeter.

The nickel-titanium composition has a thermal conductivity of about 9 to about 11 joules per Kelvin-meter-second. In an exemplary embodiment, the nickel-titanium composition has a thermal conductivity of up to about 10 joules per Kelvin-meter-second (J/K-meter-seconds) and a mean coefficient of thermal expansion of about $10.4\times10^{-6}$ per ° C.

The nickel-titanium composition manufactured in this manner may be used to further manufacture a variety of articles. These articles are those that are subjected to elevated temperatures, corrosive environments and large amounts of friction. In one embodiment, the nickel-titanium composition is used as a coating on surfaces that are subjected to elevated temperatures, corrosive environments and large amounts of friction.

Articles manufactured from the powdered composition can be used as medical devices the bodies of living beings.

Examples of medical devices include orthopedic prostheses, implants, spinal correction devices, fixation devices for fracture management, vascular and non-vascular stents, minimally invasive surgical instruments, filters, baskets, forceps, graspers, orthodontic appliances such as dental implants, arch wires, drills and files. The nickel-titanium composition can be used to produce articles for used in fluid control devices. Examples of fluid control devices are valves and valve seats, rotors, shafts and vanes. The nickel-titanium composition can also be used in machine tools such as for example tool bits, cams and gears. A variety of different gears can be manufactured from the nickel-titanium composition. Examples of suitable gears are sprockets, spur gears, crown gears, bevel gears, helical gears, hypoid gears, sun and planet gear, rack and pinion, and the like. It can also be used in aerospace and space applications.

Examples of articles than can comprise the nickel-titanium composition are spur gears, herringbone gears, bevel gears, shafts, indexing devices, valves for chemical transfer, pistons, piston rings and cylinders for internal combustion engines, ball and roller bearings, check valve balls, balls for ball valves, gates for gate valves, tool bits, parts for magnetic resonance imaging machines, threaded fasteners, locks (e.g., high strength locks), safes, quick connect couplings, submarines and surface craft parts (e.g., those surface parts exposed to salt water), wear plates and hinges used in space stations, knives and saws, shears, razor blades, drills (e.g., drills for offshore drilling, drills for oil well drilling, and the like), tank turret bearings, machine parts for water pollution testing machines, artificial hip replacements, knee joint replacements, cam shafts, sprockets, worm gears, linear ball return bearings, stamping dies, header dies, hand tools, nuts, bolts, washers, sensors, electrical contacts, electrodes, rotors, helical gears, engine parts, springs, transmission and transmission parts, pistons, piston rings, jet engine blades, cams, general valves, surfaces of turbines (e.g., gas turbines, steam turbines, wind turbines).

Articles (e.g., bearings, bushings, gears, and the like) manufactured from the nickel-titanium powdered compositions in the manner described above are devoid of voids and pinholes. In contrast, articles manufactured from molten nickel-titanium have voids and pinholes. The presence of voids and pinholes results in defective bearings, which have non-uniform properties and which can damage other parts of the equipment in which they are utilized upon undergoing failure. In one embodiment, the article may not include bearings.

In one embodiment, articles manufactured from the nickel-titanium composition are free from pinholes and voids. In another embodiment, the articles have less than or equal to about 20 volume percent of pinholes and voids, specifically less than or equal to about 10 volume percent of pinholes and voids, specifically less than or equal to about 8 volume percent of pinholes and voids, specifically less than or equal to about 7 volume percent of pinholes and voids, specifically less than or equal to about 5 volume percent of pinholes and voids, specifically less than or equal to about 3 volume percent of pinholes and voids, specifically less than or equal to about 2 volume percent of pinholes and voids, and more specifically less than or equal to about 1 volume percent of pinholes and voids.

In addition, the articles manufactured by the aforementioned methods have a uniform hardness across their surfaces prior to machining. This permits machining of articles to fine tolerances. It also permits the articles to be easily machined. In contrast, articles manufactured from a nickel-titanium melt have a non-uniform hardness across their surfaces prior to machining. In one embodiment, the articles have a uniform surface hardness of about 58 to about 62 HRC, specifically 59 to 61 HRC over a surface area of up to 5 square inches. In one embodiment, the articles have a uniform surface hardness of about 58 to about 62 HRC, specifically 59 to 61 HRC over a surface area of up to 4 square inches. In one embodiment, the articles have a uniform surface hardness of about 58 to about 62 HRC, specifically 59 to 61 HRC over a surface area of up to 2 square inches.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention.

What is claimed is:

1. A method comprising:

disposing a powdered composition in a mold; the powdered composition comprising nickel and titanium; the titanium being present in an amount of about 38 to about 42 wt % and the nickel being present in an amount of about 58 to about 62 wt %;

sintering the powdered composition to produce a sintered preform, wherein sintering the powdered composition is conducted at a first temperature of about 1800° F. to about 2200° F., a first pressure of about 3 Torr to about 5 Kg-f/cm$^2$ for a first time period of about 20 minutes to about 180 minutes;

compacting the preform;

machining the preform to form an article;

heat treating the article; the heat treating being conducted at a temperature of about 1650° F. to about 1900° F. at a pressure of about 3 Torr to about 5 Kg-f/cm$^2$ for a time period of about 10 minutes to about 5 hours; and quenching the article.

2. The method of claim 1, wherein the compacting the preform is conducted using hot isostatic pressure compaction.

3. The method of claim 2, wherein the hot isostatic pressure compaction is conducted at a second temperature of about 1700° F. to about 2250° F., a second pressure of about 2110 to about 11250 Kg-f/cm$^2$, and a second time is about 0.5 to about 20 hours.

4. The method of claim 2, wherein the hot isostatic pressure compaction is conducted at a second temperature of about 1800° F. to about 1900° F., a second pressure of about 4000 to about 8000 Kg-f/cm$^2$ and a second time of about 2 to about 5 hours.

5. The method of claim 1, wherein the heat treatment is conducted at a temperature of about 1790° F. at ambient pressure for a time period of 150 minutes.

6. The method of claim 1, further comprising vibrating the powdered composition prior to the sintering.

7. The method of claim 1, wherein the powdered composition comprises particles having an average particle size of about 50 to about 150 micrometers.

8. The method of claim 1, wherein the quenching is conducted in oil.

* * * * *